US005747941A

United States Patent [19]

Shackle et al.

[11] Patent Number: 5,747,941

[45] Date of Patent: May 5, 1998

[54] ELECTRONIC BALLAST THAT MONITORS DIRECT CURRENT THROUGH LAMP FILAMENTS

[75] Inventors: Peter W. Shackle, Arlington Heights; Randy G. Russell, Glen Ellyn, both of Ill.; Kent E. Crouse, Haltom City, Tex.; Ronald J. Bezdon, Schaumburg, Ill.

[73] Assignee: Energy Savings, Inc., Schaumburg, Ill.

[21] Appl. No.: 568,623

[22] Filed: Dec. 7, 1995

[51] Int. Cl.[6] ..... H05B 37/02

[52] U.S. Cl. ..... 315/224; 315/209 R; 315/307; 315/DIG. 5

[58] Field of Search ..... 315/307, 209 R, 315/DIG. 5, DIG. 7, 308, 224 O, 291, 219, 185 R, 160, 119

[56] References Cited

U.S. PATENT DOCUMENTS

| | | | |
|---|---|---|---|
| 3,710,177 | 1/1973 | Ward | 315/106 |
| 4,008,414 | 2/1977 | Agnew | 315/97 |
| 4,370,600 | 1/1983 | Zansky | 315/244 |
| 4,382,212 | 5/1983 | Bay | 315/225 |
| 4,562,383 | 12/1985 | Kerscher et al. | 315/225 |
| 5,170,099 | 12/1992 | Ueoka et al. | 315/291 |
| 5,214,355 | 5/1993 | Nilssen | 315/219 |
| 5,396,155 | 3/1995 | Bezdon et al. | 315/291 |
| 5,436,529 | 7/1995 | Bobel | 315/127 |
| 5,444,336 | 8/1995 | Ozawa et al. | 315/307 |

*Primary Examiner*—Robert Pascal
*Assistant Examiner*—David H. Vu
*Attorney, Agent, or Firm*—Paul F. Wille

[57] ABSTRACT

An electronic ballast includes an inverter producing pulses having a DC component, an output circuit connecting the filaments of one or more lamps in series, and a control circuit for detecting direct current through the filaments. The control circuit includes a capacitor charged by the DC component. When the voltage on the capacitor reaches a predetermined value, the ballast applies a high voltage to the lamps. The predetermined value is not reached unless a direct current passes from the output of the inverter through all lamp filaments to the capacitor. If a lamp filament is not intact, the inverter will not apply high voltage to the lamp.

5 Claims, 2 Drawing Sheets

ELECTRONIC BALLAST THAT MONITORS DIRECT CURRENT THROUGH LAMP FILAMENTS

BACKGROUND OF THE INVENTION

This invention relates to electronic ballasts for gas discharge lamps and, in particular, to an electronic ballast that avoids false starts.

A fluorescent lamp is an evacuated glass tube with a small amount of mercury in the tube. The tube is lined with an adherent layer of a mixture of phosphors. Some of the mercury vaporizes at the low pressure within the tube and a filament or cathode in each end of the tube is heated to emit electrons into the tube, ionizing the gas. A high voltage between the filaments causes the mercury ions to conduct current, producing a glow discharge which emits ultraviolet light. The ultraviolet light is absorbed by the phosphors and re-emitted as visible light.

A gas discharge lamp is a non-linear load, i.e. the current through the lamp is not directly proportional to the voltage across the lamp. Current through the lamp is zero until a minimum voltage is reached, then the lamp conducts. Once the lamp conducts, current through the lamp will increase rapidly unless there is a ballast in series with the lamp to limit current.

A magnetic ballast is an inductor in series with a lamp for limiting current. An electronic ballast is a power supply especially designed for gas discharge lamps and typically includes a rectifier for changing alternating current (AC) into direct current (DC) and an inverter for changing the direct current to alternating current at high frequency, typically 25–60 khz. Some electronic ballasts include a boost circuit between the rectifier and the inverter for increasing the voltage supplied to the inverter.

Electronic ballasts can be broadly divided between ballasts having a "half-bridge" inverter and ballasts having a "push-pull" inverter. A half-bridge inverter includes a pair of switching transistors having their emitter-collector current paths connected in series. A half-bridge is a full bridge cut along the DC diagonal of the bridge. A push-pull inverter is a full bridge cut along the AC diagonal of the bridge, i.e. the emitter-collector paths of the switching transistors are coupled in parallel. A push-pull inverter requires a transformer output whereas a half-bridge inverter does not. The output of a half-bridge inverter can be the junction of the series connected transistors.

A series resonant ballast includes an inductor and a capacitor connected in series and having a resonant frequency that is usually at or slightly below the switching frequency of the inverter. A parallel loaded inverter includes one or more lamps coupled in parallel with the resonant capacitor. The lamps themselves are connected in series. Even though the lamps are connected in series, i.e. the conductive path between the filaments of a first lamp is connected in series with the conductive path between the filaments of a second lamp, the filaments are typically connected in parallel at the junction of the lamps, at least in the U.S.A. In Europe, the filaments are connected in series at the junction of the lamps.

It is conventional for an electronic ballast to operate in two slightly different modes of operation, a first mode for starting a lamp and a second mode for running the lamp, e.g. see U.S. Pat. No. 3,710,177 (Ward). An electronic ballast typically provides higher voltage to a lamp in the start mode than in the run mode because the gases within a lamp are cooler when the lamp has been off than when a lamp has been on for a while. The higher starting voltage assures a reliable start.

There are many reasons why a lamp might not start. The most serious reason is that a person has removed one end of a lamp from a fixture and is holding the end, during re-lamping for example. An electronic ballast having two modes of operation will enter the start mode to try to start a lamp that is not there, producing dangerously high voltages at the terminals of the lamp socket. Most currently produced electronic ballasts include a circuit for detecting fault conditions and for shutting off the ballast when a fault is detected. Typically, the ballast will periodically try to start a lamp and then shut off.

In order to protect a ballast or a person touching the lamp or the ballast, it is not necessary that the ballast be turned completely off. Some ballasts react to faults by literally shutting off some or most of the circuitry in the ballast. Other ballasts, e.g. ballasts having series resonant, parallel loaded outputs, increase the operating frequency of the ballast, thereby reducing the voltage applied to the lamp. The voltage is reduced to the point that the lamp stops conducting. As used herein, "shutting off" an inverter means, at a minimum, reducing the power supplied to a lamp in order to prevent harm to the ballast, the lamp, or a person coming into contact with the ballast or the lamp.

A ballast that periodically tries to re-start is known as a "flashing" ballast. Typically, a flashing ballast produces high voltage for ten milliseconds or less and then shuts off for up to several seconds. Although the average power dissipated by the ballast is relatively small, the starting cycle is stressful on the electronic components within the ballast, particularly on the capacitors. A ballast would be more reliable if the starting cycle were initiated only when there was a functional lamp connected to the ballast.

It is known in the art to detect lamp presence by filament continuity. For example, U.S. Pat. No. 4,382,212 (Bay) discloses a push-pull inverter including a differential transformer coupled to the blue filament wires and to the red filament wires of a two-lamp ballast. If either the blue filament or the red filament is open, a current imbalance through the differential transformer causes the inverter to stop oscillating. It is not disclosed how the ballast operates when starting with an open filament. The yellow filaments, at the junction of the lamps, are connected in parallel and are not sensed.

In view of the foregoing, it is therefore an object of the invention to provide an electronic ballast including circuitry for preventing the ballast from entering a starting cycle if the filaments of a lamp are not intact.

Another object of the invention is to provide an electronic ballast including a series resonant, parallel loaded, half-bridge inverter, wherein the inverter detects lamp presence by the voltage on the half-bridge capacitor.

A further object of the invention is to provide an electronic ballast that initially applies a low voltage to an output until a predetermined time has elapsed and, if no lamp is present, does not apply a high voltage to the output; otherwise, a voltage high enough to start a lamp is applied to the output.

Another object of the invention is to provide a non-flashing, low cost ballast using a DC path through the filaments for checking continuity.

A further object of the invention is to provide a simple circuit for checking continuity of series connected lamp filaments and for preventing flashing a lamp if the filaments are not intact.

SUMMARY OF THE INVENTION

The foregoing objects are achieved in the invention in which an electronic ballast includes an inverter producing pulses having a DC component, an output circuit connecting the filaments of one or more lamps in series, and a control circuit for detecting direct current through the filaments. The control circuit includes a capacitor charged by the DC component. When the voltage on the capacitor reaches a predetermined value, the ballast applies a high voltage to the lamps. The predetermined value is not reached unless a direct current passes from the output of the inverter through all lamp filaments to the capacitor. If a lamp filament is not intact, the inverter will not apply high voltage to the lamp.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
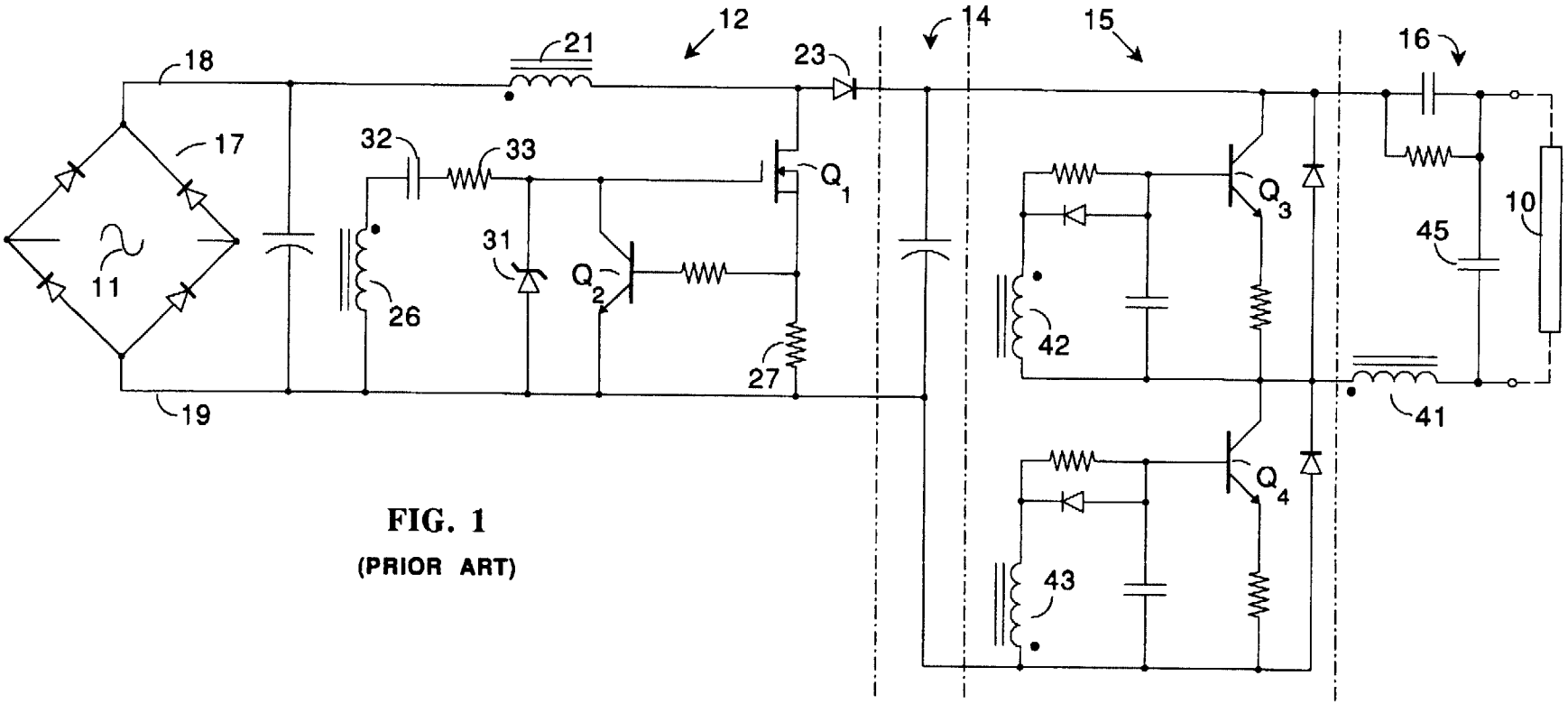
FIG. 1 (PRIOR ART)
FIG. 1 is a schematic illustration of the principal components of an electronic ballast.

FIG. 1 illustrates the major components of an electronic ballast for connecting fluorescent lamp 10 to an AC power line, represented by waveform 11. FIG. 1 is an inoperative simplification that is representative of, but not the same as, such prior art as U.S. Pat. No. 4,562,383 (Kirscher et al.) and U.S. Pat. No. 5,214,355 (Nilssen). The electronic ballast in FIG. 1 includes converter 12, energy storage capacitor 14, inverter 15, and output 16. Converter 12 rectifies the alternating current from the AC power line and stores it in capacitor 14. Inverter 15 is powered by the energy stored in capacitor 14 and provides a high frequency, e.g. 30 khz, alternating current through output 16 to lamp 10.

Converter 12 includes bridge rectifier 17 having DC output terminals connected to rails 18 and 19. If rectifier 17 were connected directly to capacitor 14, then the maximum voltage on capacitor 14 would be approximately equal to the peak of the applied voltage. The voltage on capacitor 14 is increased to a higher voltage by a flyback boost circuit including inductor 21, transistor $Q_1$, and diode 23. When transistor $Q_1$ is conducting, current flows from rail 18 through inductor 21 and transistor $Q_1$ to rail 19. When transistor $Q_1$ stops conducting, the field in inductor 21 collapses and the inductor produces a high voltage pulse, which adds to the voltage from bridge rectifier 17 and is coupled through diode 23 to capacitor 14. Diode 23 prevents current from flowing back to transistor $Q_1$ from capacitor 14.

Inductor 26 is magnetically coupled to inductor 21 and provides feedback to the gate of transistor $Q_1$, causing transistor $Q_1$ to oscillate at high frequency, i.e. a frequency at least ten times the frequency of the AC power line, e.g. 30 khz. A pulse signal must be provided to the gate of transistor $Q_1$ in order to turn $Q_1$ on and off periodically to charge capacitor 14. The source of an initial pulse signal is not shown in FIG. 1.

A boost circuit and an inverter can each be self-oscillating, triggered, or driven. In addition, each can have a variable frequency or a fixed frequency. The circuit in FIG. 1 is simplified to illustrate the basic combination of converter and inverter. As illustrated in FIG. 1, the boost circuit is a variable frequency, flyback boost, unlike the boost circuits shown in the Kirscher et al. and Nilssen patents. Resistor 27 causes the boost circuit of FIG. 1 to have a variable frequency.

Resistor 27, in series with the source-drain path of transistor $Q_1$, provides a feedback voltage that is coupled to the base of transistor $Q_2$. When the voltage on resistor 27 reaches a predetermined magnitude, transistor $Q_2$ turns on, turning off transistor $Q_1$. Zener diode 31 limits the voltage on the gate of transistor $Q_1$ from inductor 26 and capacitor 32 and resistor 33 provide pulse shaping for the signal to the gate of transistor $Q_1$ from inductor 26. Since the voltage drop across resistor 27 will reach the predetermined magnitude more quickly as the AC line voltage increases, more pulses per unit time will be produced by the boost, i.e. the frequency will increase. When the AC line voltage decreases, the frequency will decrease.

Inverter 15 is a half-bridge inverter in which transistors $Q_3$ and $Q_4$ are series connected between rails 18 and 19 and conduct alternately to provide high frequency pulses to lamp 10. Inductor 41 is series connected with lamp 10 and is magnetically coupled to inductors 42 and 43 for providing feedback to transistors $Q_3$ and $Q_4$ to switch the transistors alternately. The oscillating frequency of inverter 15 is independent of the frequency of converter 12 and is on the order of 25–50 khz. Output 16 is a series resonant LC circuit including inductor 41 and capacitor 45. Lamp 10 is coupled in parallel with resonant capacitor 45 in what is known as a series resonant, parallel loaded or direct coupled output.

Figure 2:
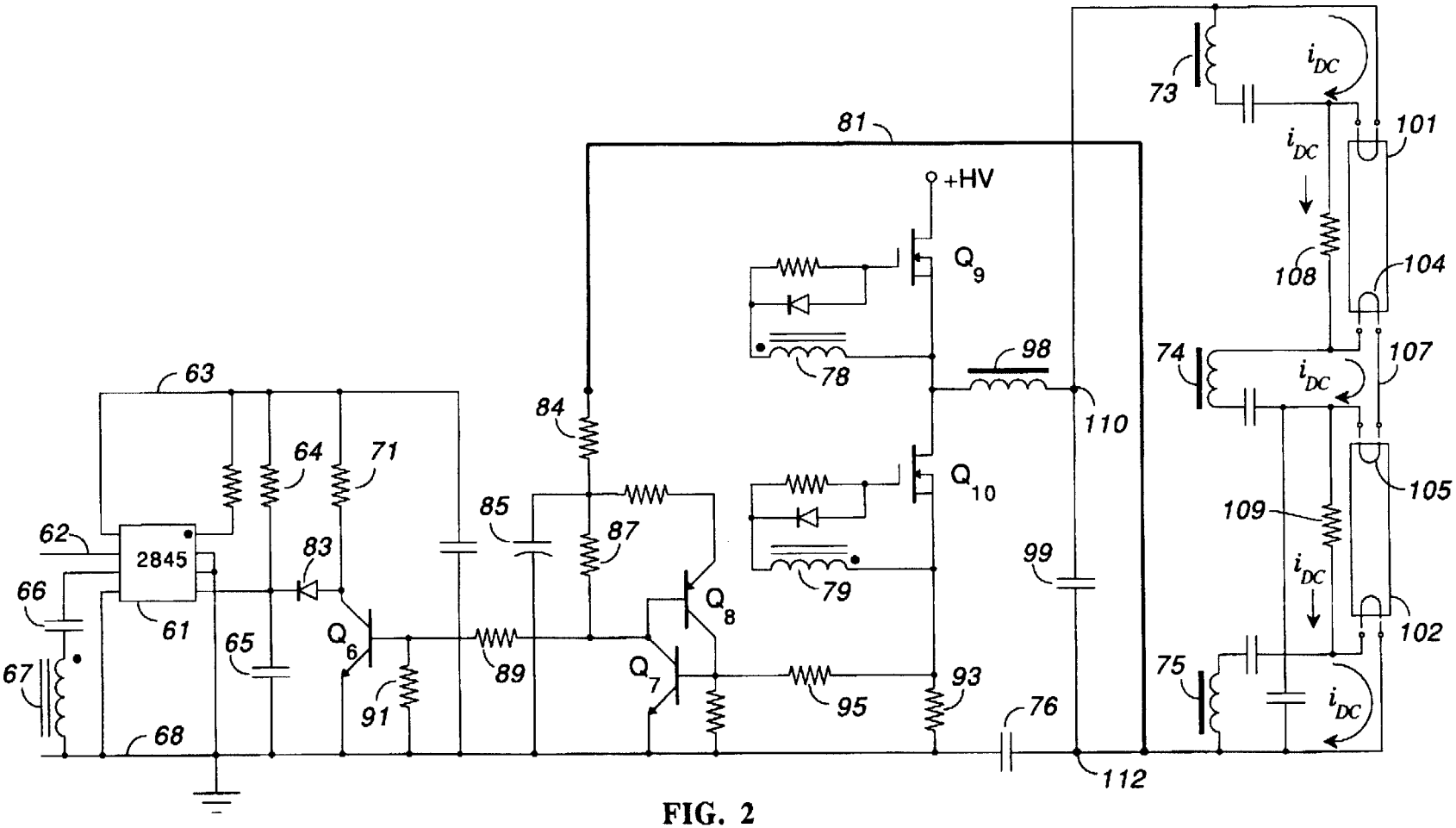
FIG. 2 is a schematic of the inverter portion of a ballast constructed in accordance with a preferred embodiment of the invention.

FIG. 2 is a schematic of a half-bridge inverter controlled by a variable frequency driver circuit and including circuitry for avoiding false starts. Driver circuit 61 is a 2845 pulse width modulator in which pin 1 is indicated by a dot and the pins are numbered consecutively clockwise. Driver circuit 61 is powered from low voltage line 62 connected to pin 7 and produces a local, regulated output of approximately five volts on pin 8, which is connected to rail 63.

Pin 1 of driver circuit 61 relates to an unneeded function and is tied high. Pins 2 and 3 relate to unneeded functions and are grounded. Pin 4 is the frequency setting input and is connected to an RC timing circuit including resistor 64 and capacitor 65. Pin 5 is electrical ground for driver circuit 61 and is connected to rail 68. Pin 6 of driver circuit 61 is the high frequency output and is coupled through capacitor 66 to inductor 67. Inductor 67 is magnetically coupled to inductor 78 and to inductor 79. As indicated by the small dots adjacent each inductor, inductors 78 and 79 are oppositely phased, thereby causing transistors $Q_9$ and $Q_{10}$ to switch alternately at a frequency determined by the RC timing circuit and the voltage on rail 63.

Resistor 71 and transistor Q6 are series-connected between rails 63 and 68 and the junction between the resistor and transistor is connected to the RC timing circuit by diode 83. When transistor Q6 is non-conducting, resistor 71 is connected in parallel with resistor 64 through diode 83. When resistor 71 is connected in parallel with resistor 64, the combined resistance is substantially less than the resistance of resistor 64 alone and the output frequency of driver circuit 61 is much higher than the resonant frequency of the LC circuit including inductor 98 and capacitor 99. When transistor Q6 is saturated (fully conducting), diode 83 is reverse biased and the frequency of driver 61 is only slightly above the resonant frequency of the LC circuit, as determined by resistor 64 and capacitor 65 alone.

Driver 61 causes transistors $Q_9$ and $Q_{10}$ to conduct alternately under the control of inductors 78 and 79. The junction between transistors $Q_9$ and $Q_{10}$ is alternately connected to a high voltage rail, designated "+HV", and ground. The current through the lamps would be a series of positive pulses were it not for half bridge capacitor 76, which detects the DC component of the pulses and charges to approximately one half of +HV. The average DC voltage on capacitor 76 causes the current through the lamps to alternate, not just pulsate. The series resonant circuit of inductor 98 and capacitor 99 causes the current through the lamps to be nearly sinusoidal.

Output terminals 110 and 112 are connected to resonant capacitor 99. An output circuit is coupled to terminals 110 and 112 and includes a DC or resistive path and an AC path. The impedance of the AC path is much lower than the impedance of the resistive path. The resistive path includes the filaments of each lamp when the lamps are not conducting. Inductor 98 is the primary winding of a transformer including inductors 73, 74, and 75 as secondaries. The secondaries heat the filaments coupled to the respective inductors. Lamps 101 and 102 are connected in series and filaments 104 and 105 are connected in series. When lamps 101 and 102 are off (not luminous), the filaments of lamps 101 and 102, conductor 107, resistor 108, and resistor 109 provide a resistive path between output terminal 110 and output terminal 112, in parallel with resonant capacitor 99. The AC path includes conductor 107 and the arc discharges through lamps 101 and 102.

When the ballast is first turned on, $Q_6$ is off, the frequency of the inverter is high, and capacitor 76 starts charging from current $i_{DC}$ through the filaments of lamps 101 and 102. The junction of capacitors 99 and 76 is connected by conductor 81 through resistor 84 and sense capacitor 85 to ground. As transistors $Q_9$ and $Q_{10}$ alternately conduct, capacitor 85 is charged through resistor 84. Capacitor 85 and resistor 84 have a time constant of about one second. The bias network including resistors 84, 87, 89, and 91 causes the average voltage across capacitor 85 to be about twenty volts during normal operation of the ballast, even though the capacitor is charged from +HV, which is at 300–400 volts.

The voltage on sense capacitor 85 represents a balance between the current into capacitor 85 through resistor 84 and the current out of capacitor 85 through resistors 87, 89 and 91 to ground. There is also some current to ground through the base-emitter junction of transistor $Q_6$. Transistor $Q_6$ is conductive but does not saturate and the transistor acts as a variable resistance between resistor 71 and ground.

The voltage on conductor 81 depends upon the filaments being intact. If one filament is open, then $i_{DC}$ is zero and the voltage on capacitor 85 remains low. Transistor $Q_6$ operates in a linear mode as a variable resistance. If the voltage on capacitor 85 is low, $Q_6$ remains a high resistance and the frequency of driver 61 remains high. When the frequency of the inverter is high, the voltage across resonant capacitor 99 is low. The ballast can remain running in this state with very little stress on the ballast because the voltages are low.

If all filaments are intact, capacitor 85 charges, increasing the current into transistor $Q_6$, reducing the resistance of $Q_6$ and decreasing the frequency of the inverter. As the frequency decreases, the voltage on resonant capacitor 99 increases and, at some point, lamps 101 and 102 will conduct. If a filament should open while the lamps are on, the ballast will continue to operate unless the voltage on capacitor 99 becomes excessive.

Over-voltage protection is provided by transistors $Q_7$ and $Q_8$ which are a complementary pair connected in SCR configuration. The current through transistor $Q_{10}$ is sensed by resistor 93. The current is converted to a voltage and coupled by resistor 95 to the base of transistor $Q_7$, which acts as the gate or control input of the SCR. When the voltage across resistor 93 reaches a predetermined level, transistors $Q_7$ and $Q_8$ are triggered into conduction, shorting the base of transistor $Q_6$ to ground and turning off transistor $Q_6$. When transistor $Q_6$ shuts off, the frequency of driver 61 is at a maximum, as described above. When transistor $Q_6$ shuts off, the frequency of driver 61 is high and the voltage drop across resonant capacitor 99 is insufficient to sustain the lamps, extinguishing the lamps. Sense capacitor 85 is discharged by $Q_7$ through resistor 87.

The invention thus provides a low cost circuit for preventing false starts. Current through series connected filaments charges the capacitor in a control circuit for shutting off the inverter. If a filament is open, the starting cycle does not occur and the ballast cannot flash because the starting cycle is inhibited. In a preferred embodiment of the invention, the control circuit is coupled to the half-bridge capacitor in a series resonant, parallel loaded inverter.

Having thus described the invention, it will be apparent to those of skill in the art that various modifications can be made within the scope of the invention. For example, the circuitry for sensing direct current through the filaments of the lamps can be used with any inverter connecting all the filaments in series, including inverters employing pulse width modulation for controlling the power to a lamp. The invention can be used in ballasts for powering one or more lamps.

What is claimed as the invention is:

1. An electronic ballast for powering a gas discharge lamp, said ballast comprising:

a variable frequency inverter having a series resonant, parallel loaded output, said inverter producing high frequency pulses having a direct current component;

said inverter including a resistive path in parallel with the resonant capacitor in said series resonant, parallel loaded output, said loath including means for connecting at least one filament of said lamp in series with said path;

a control circuit coupled to said inverter, said control circuit including a sense capacitor charged by the direct current component through said resistive path;

said control circuit operating said inverter at a first frequency near the resonant frequency of said series resonant, parallel loaded output when the voltage on said sense capacitor is greater than a predetermined voltage;

said control circuit operating said inverter at a second frequency when the voltage on said sense capacitor is less than said predetermined voltage, wherein said second frequency is higher than said first frequency.

2. The electronic ballast as set forth in claim 1 wherein said resistive path includes a resistor connected in series with at least one of said filaments.

3. The electronic ballast as set forth in claim 2 wherein said inverter is a half-bridge inverter and includes a half-bridge capacitor connected in series with said resistive path, wherein said sense capacitor is coupled to said half-bridge capacitor.

4. The electronic ballast as set forth in claim 3 and further including overvoltage sensing means coupled to said control circuit for discharging said sense capacitor when an excess voltage is detected in said inverter.

5. The electronic ballast as set forth in claim 4 wherein said overvoltage sensing means includes:

a sense resistor coupled in series with the switching transistors in said half-bridge inverter;

a switch coupled to said sense resistor and triggered by the voltage across said sense resistor, wherein said switch is coupled in parallel with said sense capacitor for discharging the sense capacitor.

* * * * *

UNITED STATES PATENT AND TRADEMARK OFFICE

CERTIFICATE OF CORRECTION

PATENT NO : 5,747,941

DATED : May 5, 1998

INVENTOR(S) : Shackle et al.

It is certified that error appears in the above-identified patent and that said Letters Patent is hereby corrected as shown below:

Column 6, line 31, should read as follows.

"loaded output, said path including means for connect-"

Signed and Sealed this

Fourteenth Day of July, 1998

Bruce Lehman

*Attest:*

BRUCE LEHMAN

*Attesting Officer*

*Commissioner of Patents and Trademarks*

Disclaimer 5,747,941—Peter W. Shackle, Arlington Heights; and Randy G. Russell, Glen Ellyn, both or Ill.; Kent E. Crouse, Haltom City, Tex.; and Ronald J. Bezdon, Schaumburg, Ill. ELECTRONIC BALLAST THAT MONITORS DIRECT CURRENT THROUGH LAMP FILAMENTS. Patent dated May 5, 1998. Disclaimer filed Oct. 1, 1998, by the assignee, Energy Savings, Inc.

Hereby enters this disclaimer to claims 1, 2, 3, 4, and 5 of said patent.

*(Official Gazette,* November 17, 1998)